US006302154B1

(12) United States Patent
Bassi et al.

(10) Patent No.: US 6,302,154 B1
(45) Date of Patent: Oct. 16, 2001

(54) SPRING CONNECTION DEVICE AND ASSEMBLY IN A JACQUARD HARNESS

(75) Inventors: Dario Bassi, Chaponnay; Patrick Vessella, Decines Charpieu, both of (FR)

(73) Assignee: Staubli Lyon, Chassieu (FR)

( * ) Notice: Subject to any disclaimer, the term of this patent is extended or adjusted under 35 U.S.C. 154(b) by 0 days.

(21) Appl. No.: 09/695,908

(22) Filed: Oct. 26, 2000

(30) Foreign Application Priority Data

Oct. 28, 1999 (FR) ..... 99 13761

(51) Int. Cl.[7] ..... D03C 3/40; D03C 3/42
(52) U.S. Cl. ..... 139/85; 24/614
(58) Field of Search ..... 24/612, 614, 615, 24/639, 642; 139/85

(56) References Cited

U.S. PATENT DOCUMENTS 4,513,789 * 4/1985 Bowen, Jr. ..... 139/85
4,777,986 10/1988 Brochier .
5,636,663 * 6/1997 Lacroix ..... 139/85
5,791,382 * 4/1985 Froment et al. ..... 139/85
5,819,809 10/1998 Bassi et al. .

FOREIGN PATENT DOCUMENTS 8609665 5/1986 (DE) .
0263764 4/1988 (EP) .
2674264 9/1992 (EP) .
0678603 10/1995 (EP) .
2756848 6/1998 (EP) .
2756849 6/1998 (EP) .

* cited by examiner

*Primary Examiner*—Andy Falik
(74) *Attorney, Agent, or Firm*—Dowell & Dowell, P.C.

(57) ABSTRACT

Springs associated with a harness of a weaving loom of the Jacquard type are connected on a frame of the loom by an assembly of devices each of which includes a plurality of rods each being connectable with a spring and which rods extend from a common base. Each base is provided with hooks adapted to engage with beaks of corresponding shape for mounting each device on at least one elongated section secured to the frame of the loom.

13 Claims, 5 Drawing Sheets

SPRING CONNECTION DEVICE AND ASSEMBLY IN A JACQUARD HARNESS

BACKGROUND OF THE INVENTION

1. Field of the Invention

The present invention relates to a device for connecting springs associated with a harness of a weaving loom of the Jacquard type on a frame of such a loom, to a connection assembly comprising such a device, and to a weaving loom of the Jacquard type incorporating such an assembly.

2. Description of Related Art

Each hook of a Jacquard system is known to be associated with one or more cords, the cords together constituting the harness of the system. Each cord is connected to the upper end of a heddle provided with a mail for controlling the position of a warp yarn of the loom in a substantially vertical direction. The lower end of each heddle is connected to an anchoring point, fixed with respect to the frame of the loom, by a spring exerting an elastic return force on the heddle.

EP-A-0 678 603, for example, discloses providing a device for connecting the lower end of a helical spring and the frame of a loom by means of a threaded joining piece intended to be screwed in the coils or turns of the spring and comprising two elastic branches adapted to cooperate with the coils or turns of the spring to generate friction to avoid resonance of the latter. This document provides an individual fixation of the connection device on the frame by means of a joining piece in the form of a harpoon, which involves long and fastidious manipulations and accordingly renders the equipping of a weaving loom of Jacquard type with devices of this type more expensive. In case of dismantling, each joining piece must be dismantled individually and it is not rare for joining pieces to deteriorate.

It is known, for example by DE-U-86 09665, to group together connection devices on a base extending in a rod provided with a head in the form of a harpoon for hooking thereof on a harness board. Such devices are difficult to unhook and their density of implantation, in particular on an elongated section, cannot be high.

It could be envisaged to group together the connection devices, for example in series of four on a base presenting a central orifice in which is introduced a bar supported above the frame. Although presenting advantages over the known art of EP-A-0 678 603, this system and the known one of DEU-86 09665 involve removing a large number of devices from the bar in order to have access to a device having to be changed during a maintenance operation, which proves to be long, fastidious and expensive due to the need for highly qualified manpower. Similarly, it is a complex operation to assemble a weaving loom incorporating this device. In addition, flock tends to accumulate between the devices of this type and it is delicate to clean them.

It is a particular object of the present invention to overcome these drawbacks by proposing a spring connection device which comprises a plurality of rods each equipped with means for connection with a spring and extending from a common base.

SUMMARY OF THE INVENTION

According to the invention, such a device is characterized in that the base is provided with hooks each adapted to cooperate with a beak of corresponding shape for elastic hooking and unhooking of this device on and from at least one elongated section.

Thanks to the invention, the fastening formed by the base and the different rods that it supports may be installed on the section particularly rapidly and dismantled equally rapidly, without requiring concomitant assembly or dismantling of the adjacent fastenings. The different rods of a device may be mounted and dismantled in groups with respect to the weaving loom. The flexible hooks and the beaks allow rapid elastic hooking and unhooking on or from the elongated sections.

According to advantageous but non-compulsory aspects of the invention, the device incorporates one or more of the following characteristics:

- The base is substantially planar and adapted to be arranged in a direction substantially perpendicular to a longitudinal direction of the section. The planar nature of the base makes it possible to juxtapose the fastenings in the longitudinal direction of the section with a higher density of the rods intended to cooperate with the springs of the harness. All the springs of the same column located in the harness board depth may be provided to be grouped together on the same fastening disposed in the direction of advance of the warp yarns, while the section extends in a direction substantially parallel to the weft yarns.
- The rods are juxtaposed essentially along a principal plane of the base. In other words, the rods form a substantially planar lap extending the base.
- The base is pierced with a central orifice constituting a handle for gripping the device, for example for positioning it on a section.
- The hooks and the beaks are oriented so that their respective contact surfaces are included in the thickness of the base, which makes it possible to juxtapose the bases, and consequently the rods, with a high density.
- The base comprises at least one maneuvering element defining a zone of reception of part of a tool for unhooking the device with respect to the elongated section.
- The device comprises at least one positioning tongue adapted to cooperate with a guiding member secured to the elongated section. This tongue and member make it possible to arrange the different devices with a predetermined pitch defined by this member.

The invention also relates to an assembly for connection of the springs of harness of Jacquard type, which comprises a plurality of devices as described hereinbefore and at least one elongated section fast with the frame of the loom and defining, in a transverse section, at least one beak adapted to cooperate with the hooking means provided on these devices. In addition, at least one spacer bar may be provided to be immobilized on the section and presenting zones for receiving part of the bases of these devices, with a predetermined spaced apart relationship in the longitudinal direction of the section.

Finally, the invention relates to a weaving loom of Jacquard type comprising an assembly as described hereinbefore. Such a weaving loom is relatively easy to assemble and maintain, while being as efficient as the known looms and its cost price and maintenance costs being substantially lower than known looms.

BRIEF DESCRIPTION OF THE DRAWINGS

The invention will be more readily understood on reading the following description of two embodiments of a connection device in accordance with its principle, given solely by way of example and made with reference to the accompanying drawings, in which.

DESCRIPTION OF PREFERRED EMBODIMENTS

Figure 1:
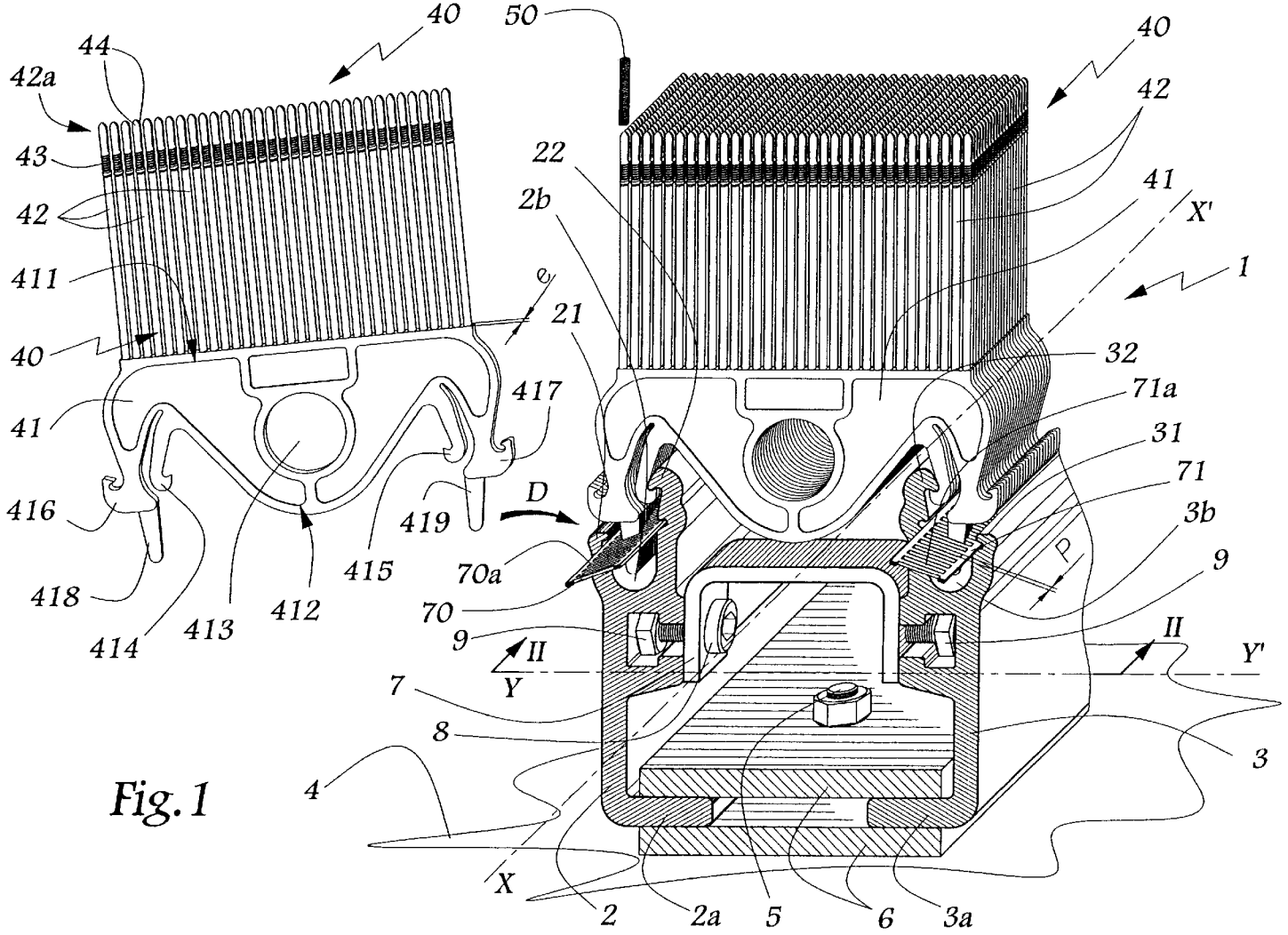
FIG. 1 schematically shows the lower part of a weaving loom in the course of being equipped with a spring connection assembly according to the invention.
Figure 2:
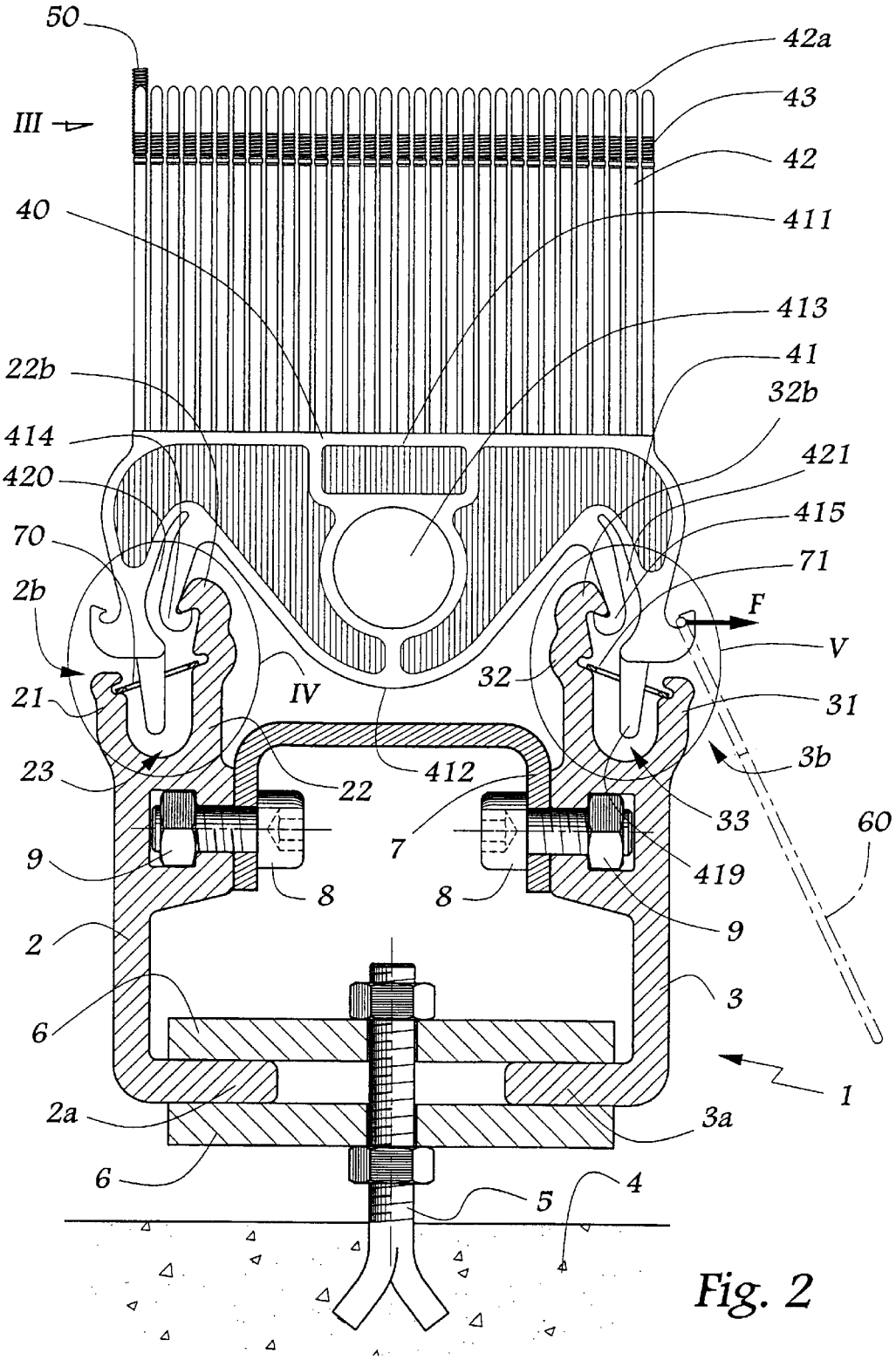
FIG. 2 is a section along line II—II in FIG. 1.
Figure 3:
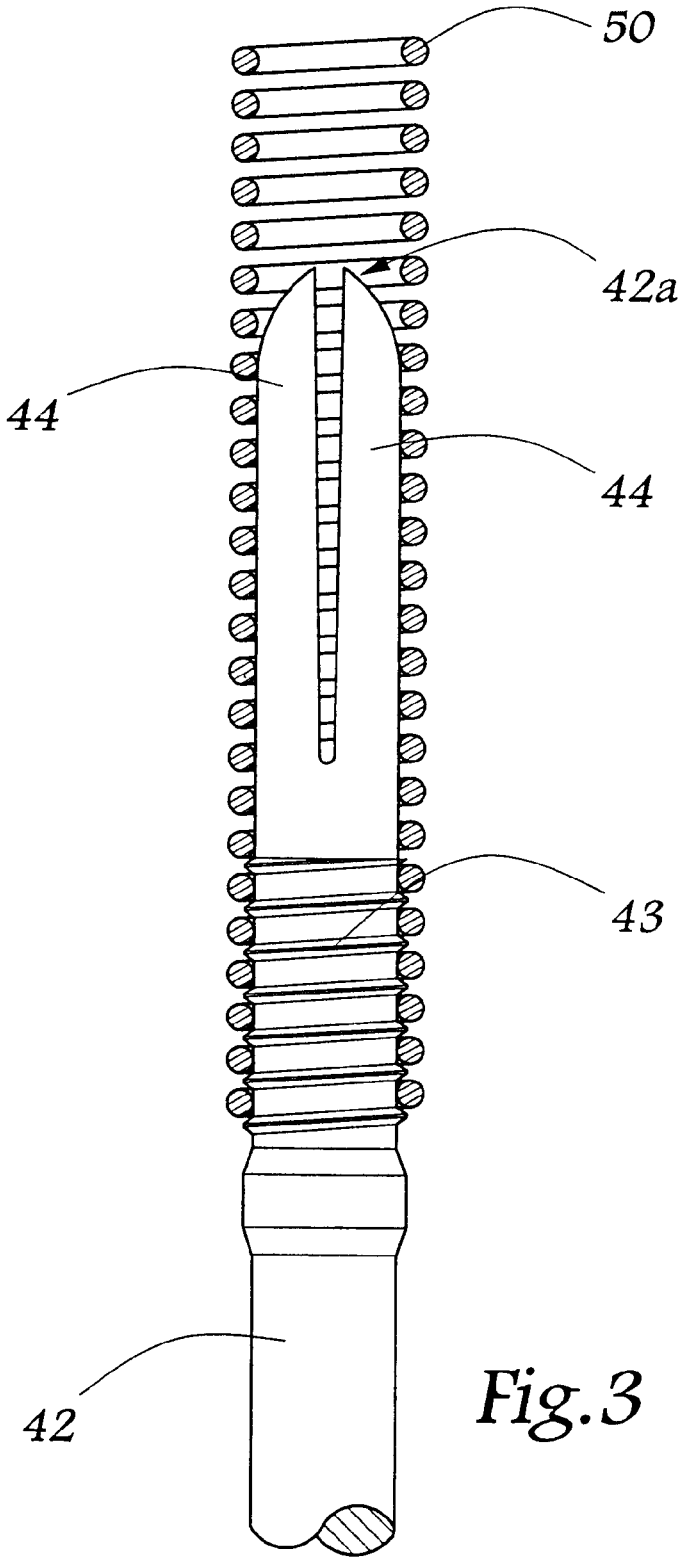
FIG. 3 is a view on a larger scale of detail III in FIG. 2.
Figure 5:
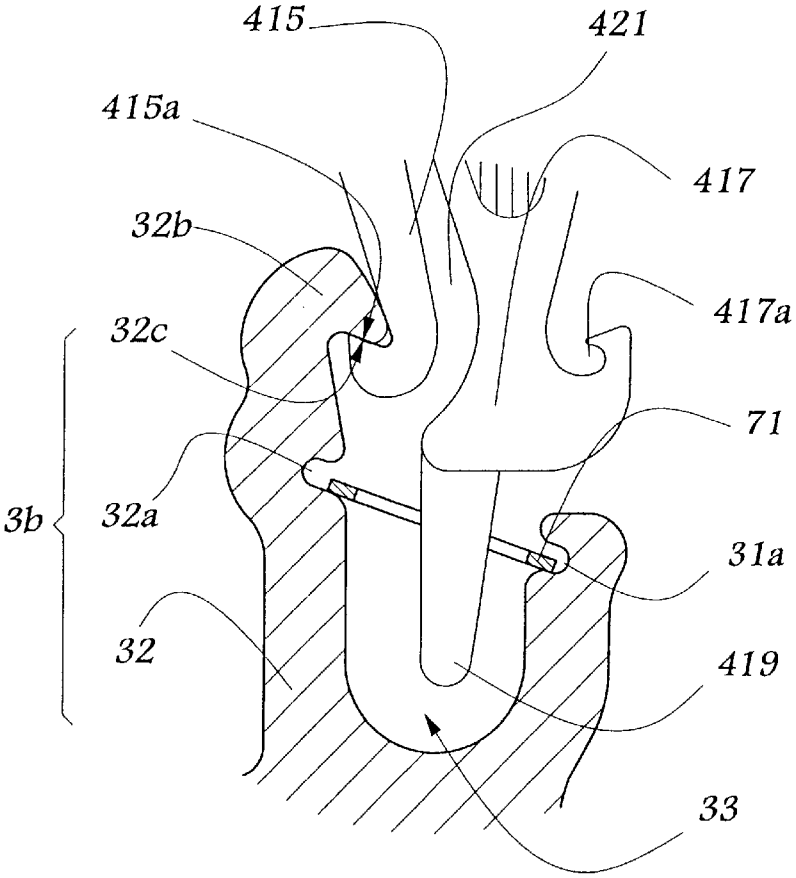
FIG. 5 is a view on a larger scale of detail V in FIG. 2.
Figure 4:
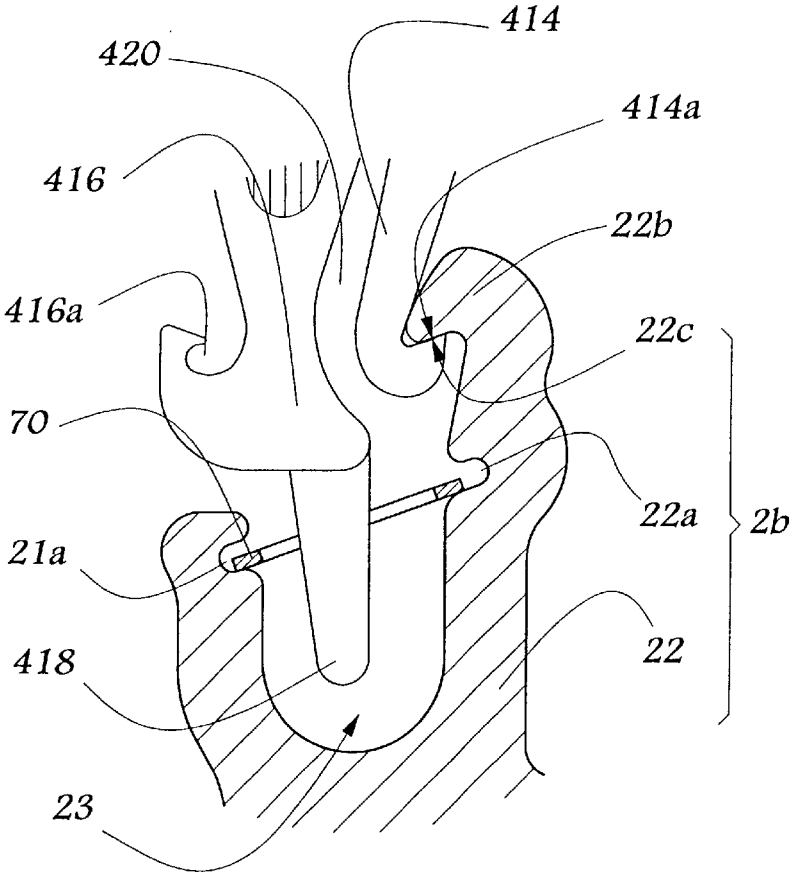
FIG. 4 is a view on a larger scale of detail IV in FIG. 2.

Referring now to the drawings, the assembly 1 shown in FIGS. 1 and 2 comprises two rails 2 and 3 formed by aluminium sections and mounted on the lower frame 4 of a weaving loom thanks to a plurality of threaded rods of which only one has been shown in FIGS. 1 and 2 with reference 5. The frame 4 is sometimes called the "floor" of the loom, the term frame meaning that the element 4 is a fixed part belonging to the structure of the loom. Each threaded rod 5 is associated with plates 6 forming clamps for tightening and immobilizing the lower flanges 2*a* and 3*a* of the rails 2 and 3. Rails 2 and 3 extend in a direction X–X' substantially perpendicular to the direction Y–Y' of advance of the warp yarns in the loom, direction X–X' thus being substantially parallel to the direction of introduction of the weft yarns in the shed.

Spacer members are arranged between the rails 2 and 3, enabling their spaced apart relationship to be maintained at a substantially constant value. Only one spacer member 7 is visible, but the spacer members are distributed over the whole length of the rails 2 and 3. Screws 8 cooperate with captive nuts 9 distributed over the length of the rails or sections 2 and 3 in order to immobilize these sections with respect to the spacer members 7 and equivalent.

The upper part 2*b* of the rail 2 constitutes an elongated section formed by two branches 21 and 22 defining therebetween a longitudinal channel 23. The outer branch 21 is provided with a longitudinal groove 21*a*, while the inner branch 22 is provided with a longitudinal groove 22*a*. The terminal part 22*b* of the branch 22 forms a beak or hook oriented outwardly of the space defined between the rails 2 and 3.

Similarly, the upper part 3*b* of the rail 3 constitutes an elongated section formed by two branches 31 and 32 defining therebetween a channel 33, these ranches 31 and 32 each being provided with a longitudinal groove 31*a*, 32*a*, respectively, while the branch 32 forms a beak or hook 32*b* in its terminal part.

A plurality of fastenings 40 are distributed over the assembly formed by the two rails 2 and 3 in the direction X–X', cooperating with the sections 2*b* and 3*b*. Each fastening 40 is formed by a base 41 and by thirty-two rods 42 of which the free, or upper, end 42*a* is provided to engage in the inner volume of a spring 50 of helical type. Only one spring 50 has been shown in the Figures, but each rod 42 is provided to cooperate with a spring.

The end 42*a* of each rod 42 is provided with a thread 43 adapted to cooperate with the turns of the corresponding spring 50 and with two divergent branches 44 intended to rub against the inner surface of the spring 50. Other geometries may be envisaged for the connection means 43 and 44 provided at the end 42*a* of each rod 42, in accordance with the respective technical teachings of FR-A-2 766 501 and EP-A-0 678 603, or with other approaches.

The base 41 and the rods 42 consist of a single piece made by injection-molding of plastics material, such as polyamide (PA) or polyoxymethylene (POM).

The base 41 is substantially planar. The plane of symmetry of each fastening 40 is also the plane symmetry of the base 41 and of the rods 42 of such a fastening. The thickness e of each base 41 perpendicularly to its plane of symmetry is relatively small, i.e., less than 5 mm and preferably of the order of 2 mm.

The upper edge 411 of the base 41 is substantially rectilinear and perpendicular to the rods 42.

The lower edge 412 of the base 41 is rounded and convex, with the result that it may be engaged between the branches 22 and 32, above the spacer members 7, the material constituting the base 41 providing the fastening 40 with sufficient rigidity. In its central part, the base 41 is pierced with an orifice 413 constituting a handle for gripping the fastening 40, in particular when the springs 50 are positioned on the ends 42*a* of the rods 42.

The base 41 also bears two elastic hooks 414 and 415 intended to cooperate with the beaks or hooks 22*b* and 32*b* of the branches 22 and 32 for an elastic hooking of each fastening 40 on the sections 2*b* and 3*b*. Elastic hooking can be obtained thanks to the elastically deformable nature of the hooks 414 and 415 which are made of plastics material since they are in one piece with the base 41.

The geometry of the hooks 414 and 415 and of the beaks 22*b*, 32*b* is such that the contact surfaces 414*a*, 22*c*, 415*a* and 32*c* of these hooks and beaks are located in the thickness of the base 41 when the latter is in position. The fastenings 40 may therefore be juxtaposed on the rails 2 and 3 with a high density.

The base 41 also extends in two handles 416 and 417 outside the hooks 414 and 415 with respect to the orifice 413. The hook 414 and the handle 416 are separated by a clearance slit 420 while the hook 415 and the handle 417 are separated by a similar slit 421. The handles 416 and 417 each define a zone 416*a* or 417*a* for receiving a tool 60, shown solely in dashed and dotted lines in FIG. 2, for exerting an effort F for unhooking hooks 414 and 415 engaged on the beaks 22*b* and 32*b*.

In the embodiment shown in FIG. 2, the flexible nature of the hook 414 is used for allowing the hook 415 to be unhooked from the beak or hook 32*b*. Of course, the tool 60 might be used on the handle 416 to allow unhooking in the opposite direction.

The fact that a handle 416 or 417 is provided on each side of the base 41 allows for unhooking the fastening 40, including when the latter is accessible by one side and independently of its direction of assembly.

Handles 416 and 417 extend respectively in tongues 418 and 419 provided to penetrate in orifices 70*a* and 71 a of two guide bars 70 and 71 arranged respectively in the channels 23 and 33, being slid in grooves 21*a* and 22*a*, 31*a* and 32*a*, respectively. The pitch p of the orifices 70*a* and 71*a* on the bars 70 and 71 determines the pitch of installation of the bars 70 on the rails 2 and 3. This pitch is chosen to be slightly greater than the thickness e of the fastenings 40.

As shown in FIG. 1, when it is necessary to add a fastening 40 on the rails 2 and 3, this fastening is arranged above the rails, being displaced in a direction substantially parallel to its principal plane, as represented by the arrow of displacement D, then applied in the direction of plates 6, the rounded shape of the hooks 414 and 415 cooperating with the likewise rounded shape of the beaks 22*b* and 32*b* in order to allow automatic hooking by elastic deformation of these hooks. Each fastening 40 is thus arranged with its principal plane parallel to the direction Y–Y'. The adjustment in direction X–X' is effected by relying on the pitch of the orifices 70*a* and 71*a*.

Dismantling is effected with the aid of the tool 60 as indicated hereinabove, in particular when one of the rods is damaged. Dismantling can also be effected by hand, by exerting an effort of traction on one of the handles 416 or 417 or on another part of the base 41.

Figure 6:
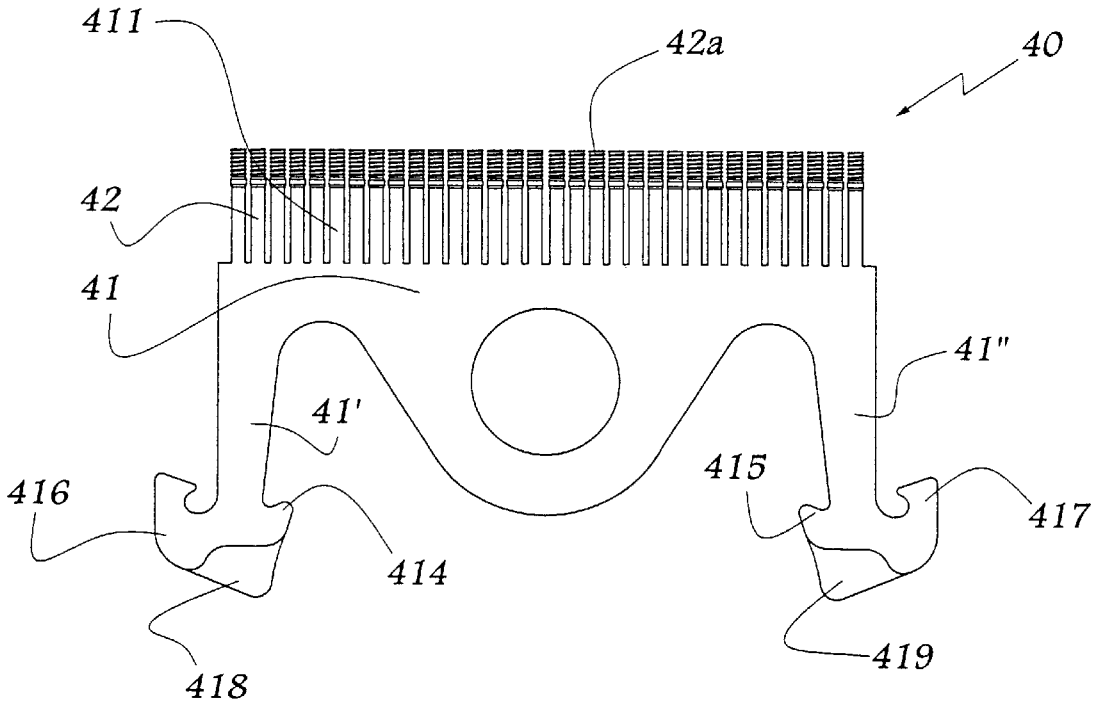
FIG. 6 is a front view of a device in accordance with a second embodiment of the invention.

In the second embodiment of the invention shown in FIG. 6, elements similar to those of the first embodiment bear identical references. The fastening 40 of this embodiment is intended to be mounted on a section of the type formed by the rails 2 and 3 shown in FIGS. 1, 2, 4 and 5. This fastening differs from the preceding one in that the rods 42 are substantially shorter than those of the first embodiment and in that their ends 42*a* do not present any branches.

The hooks 414 and 415 are respectively formed at the end of two elements 41' and 41" extending from the base 41 opposite the edge 411. The handles 416 and 417 for maneuvering the hooks 414 and 415 are also arranged on these elements 41' and 41", with the result that there is no slit separating these hooks and these handles as in the first embodiment. The bending movements of the elements 41' and 41" allow elastic hooking and unhooking of the hooks 414 and 415 on and from the corresponding beaks of the section.

Positioning tongues 418 and 419 are also provided in the lower part of elements 41' and 41" and are intended to cooperate with spacer bars of the type such as bars 70 and 71 described with reference to the first embodiment. These tongues 418 and 419 may present a thickness different from that of the rest of the elements 41' and 41".

A shed forming device equipped with an assembly as shown in FIG. 1 is easy to install on a weaving loom, being particularly reliable and its maintenance being greatly simplified with respect to the devices of the state of the art. A weaving loom equipped with such a device is therefore cheaper to install and maintain than the known looms.

The geometry of the beaks 414 and 415 and of the hooks 22*b* and 32*b* may be changed without departing from the scope of the present invention. In particular, the beaks of the base may be provided to be arranged between the hooks formed by the elongated section.

What is claimed is:

1. A device for connecting springs associated with a harness of a weaving loom of a Jacquard type to a frame of the loom, and wherein an elongated section is adapted to be mounted to the frame, the elongated section having spaced rails each including a beak element, the device including a plurality of rods aligned in a row and extending upwardly from a common base, said base having a width substantially equal to a length defined by said row of said plurality of rods, each of said rods having means for connecting with one of the springs, said common base including spaced hooks, and said spaced hooks being resilient for resiliently engaging the beak elements of the rails to thereby secure the device to the frame of the loom.

2. The device of claim 1, wherein said base is substantially planar and adapted to be mounted to the elongated section in a direction substantially perpendicular to a longitudinal direction of the elongated section.

3. The device of claim 2, wherein said rods are juxtaposed along a principal plane of said base and said spaced hooks.

4. The device of claim 1, wherein said base includes an orifice defining a handle area for gripping the device.

5. A device for connecting springs associated with a harness of a weaving loom of a Jacquard type to a frame of the loom, and wherein an elongated section is adapted to be mounted to the frame, the elongated section having spaced rails each including a beak element, the device including a plurality of rods extending from a common base, each of said rods having means for connecting with one of the springs, said common base including spaced hooks for resiliently engaging the beak elements of the rails to thereby secure the device to the frame of the loom, and said hooks and said beaks are oriented so that respective contact surfaces thereof are located within a thickness of said base.

6. A device for connecting springs associated with a harness of a weaving loom of a Jacquard type to a frame of the loom, and wherein an elongated section is adapted to be mounted to the frame, the elongated section having spaced rails each including a beak element, the device including a plurality of rods extending from a common base, each of said rods having means for connecting with one of the springs, said common base including spaced hooks for resiliently engaging the beak elements of the rails to thereby secure the device to the frame of the loom, and said base includes at least one handle defining an element for receiving a part of a tool for unhooking the device with respect to the elongated section.

7. The device of claim 6, wherein said base includes at least one positioning tongue extending therefrom adapted to cooperate with a guiding member mounted to the elongated section.

8. The device of claim 6 wherein said base includes a pair of handles extending outwardly on opposite sides of said hooks, each of said handles defining an element for receiving a part of a tool for unhooking the hooks from the beaks of the elongated section.

9. An assembly for connecting springs associated with a harness of a weaving loom of a Jacquard type to a frame of the loom, the assembly including; at least one elongated section adapted to be secured to the frame and having spaced beak portions, a plurality of connecting devices, each of said connecting devices including a plurality of rods extending upwardly from a common base, each of said rods having means for connecting with one of the springs, each base including spaced hooks which are resilient for resiliently engaging said beak portions of said at least one elongated section to thereby secure each of said plurality of connecting devices to said at least one elongated section, and each base including at least one handle defining an element for being engaged by a part of a tool for unhooking each device with respect to said at least one elongated section.

10. The assembly of claim 9 wherein said at least one elongated section includes spaced rails, each of said rails including one of said beak portions.

11. The assembly of claim 10 wherein each of said bases includes a pair of said handles engageable by a tool for unhooking each of said plurality of connecting devices from said at least one elongated section.

12. The assembly of claim 9 including at least one spacer bar secured to said at least one elongated section and provided with zones for receiving a part of each of said bases of said plurality of connecting devices, said zones being a predetermined distance apart in a longitudinal direction of said at least one elongated section.

13. A weaving loom of the Jacquard type including a frame, a plurality of springs associated with a harness, an assembly for connecting said plurality of springs to said frame, said assembly including at least one elongated section secured to the frame and having spaced beak portions, a plurality of connecting devices, each of said connecting devices including a plurality of rods extending upwardly from a common base, each of said rods having means for connecting with one of the springs, each base including spaced hooks which are resilient for resiliently engaging said beak portions of said at least one elongated section to thereby secure each of said plurality of connecting devices to said at least one elongated section, and each base including at least one handle defining an element for being engaged by a part of a tool for unhooking each device with respect to said at least one elongated section.

* * * * *